US007640882B2

(12) United States Patent
Parniske

(10) Patent No.: US 7,640,882 B2
(45) Date of Patent: Jan. 5, 2010

(54) BOAT COVER ATTACHMENT GUIDE AND BOAT COVER

(75) Inventor: Dennis J. Parniske, Braedenton, FL (US)

(73) Assignee: Taylor Made Group, LLC, Gloversville, NY (US)

( * ) Notice: Subject to any disclaimer, the term of this patent is extended or adjusted under 35 U.S.C. 154(b) by 79 days.

(21) Appl. No.: 11/932,854

(22) Filed: Oct. 31, 2007

(65) Prior Publication Data

US 2009/0107389 A1 Apr. 30, 2009

(51) Int. Cl.
*B63B 17/00* (2006.01)

(52) U.S. Cl. ..... 114/361

(58) Field of Classification Search ..... 114/361
See application file for complete search history.

(56) References Cited

U.S. PATENT DOCUMENTS 3,172,419 A * 3/1965 Lewis ..... 135/119
6,026,761 A * 2/2000 Parniske et al. ..... 114/343
6,032,433 A * 3/2000 Hatziathanasiou ..... 52/742.12
7,281,486 B2 * 10/2007 Bach et al. ..... 114/361

* cited by examiner

*Primary Examiner*—Ed Swinehart
(74) *Attorney, Agent, or Firm*—Nixon & Vanderhye P.C.

(57) ABSTRACT

An apparatus for attaching a boat cover to a boat is disclosed. The apparatus includes an elongated member defining a first leg and a second leg. A plurality of notches are defined in the first leg of the elongated member. A flexible cover is affixed to the second leg of the elongated member along at least one edge. A guide is affixable to a deck of a boat. The guide defines at least one securement groove therein. The securement groove accepts the second leg of the elongated member therein.

11 Claims, 7 Drawing Sheets

BOAT COVER ATTACHMENT GUIDE AND BOAT COVER

CROSS-REFERENCE TO RELATED APPLICATIONS

This is a first-filed patent application and does not rely on any other patent application for priority.

FIELD OF THE INVENTION

The invention relates to a boat cover attachment guide and boat cover. More specifically, the invention relates to a design that facilitates installation of a boat cover on a boat.

DESCRIPTION OF THE RELATED ART

In the boating industry, it is common for boat owners to cover their boats during periods of non-use. Alternatively, it is common for boat owners to cover the exposed passenger areas of a boat in unfavorable weather conditions, i.e., when it is raining.

In the prior art, it is common for a boat to include a plurality of male portions of snap fasteners at the periphery of the area to be covered by the boat cover. At the windshield of the boat, the male portions of the snap fasteners typically are affixed at regular intervals along the top rail of the windshield. Along other structures, such as along a radar arch, which typically extends above the passenger area of the boat, the male portions of the snap fasteners are affixed directly to the deck.

The boat cover has attached to it the female portions of snap fasteners. When the cover is properly positioned on the boat, the male and female portions of the snap fasteners are in register with one another so that they may be connected to one another, thereby affixing the boat cover to the boat.

One drawback to the use of snap fasteners is that the male portion of the snap fasteners remains on the top rail of the windshield or on the deck of the boat after the cover is removed. This arrangement is considered by some to be unsightly. There are those that would prefer not to have the male portions of the snap fasteners visible.

Snap fasteners are also difficult to connect to one another when the cover of the boat is large. As should be appreciated by those skilled in the art, the cover of the boat may be difficult for the boat operator to lift and, at the same time, manipulate so that the snap fasteners are in register with one another.

In addition, it is not uncommon for a boat owner to have difficulty matching the male and female portions of the snap fasteners to one another without mismatching at least one of the plurality of fasteners to one another. This may lead to some frustration as the boat cover may need to be partially removed in order for the snaps to be realigned and re-attached to one another.

Other prior art attachment systems are illustrated in FIGS. 1 and 2.

FIGS. 1 and 2 illustrate two variations of a prior art track system that permits a cover 100 to be attached to a boat.

Referring to FIG. 1, a track 102 is affixed to the deck of a boat via a plurality of screws 104. The cover 100 engages the track 102 when an edge welt 106, which is part of an insert 108, in threaded into a groove 110 in the track 102. As illustrated, the screws 104 are located within the groove 110. Accordingly, when the cover 100 is removed from the track 102, the heads of the screws 104 are visible. This is considered unsightly by many boat owners.

As illustrated in FIG. 1, the insert 108 includes the welt 106 and a protruding portion 112. An edge of the cover 100 is sewn onto the protruding portion 112, thereby affixing the insert 108 to the edge of the cover 100. The unfinished edge of the cover 100 is capped with a U-shaped cover 114.

FIG. 2 illustrates a variation of the prior art system shown in FIG. 1. In FIG. 2, the track 116 is largely the same as the track 102, except that the track 116 includes a lateral leg 118. The screws 104 that attach the track 116 to the deck of the boat are disposed through the lateral leg 118. In this embodiment, the heads of the screws 104 are visible. Again, this is considered unsightly by many boat owners and enthusiasts.

As in the prior art example illustrated in FIG. 1, the cover 100 is attached to the protruding portion 112 on the insert 108. As in the prior example, the insert 108 slides into a groove 110 in the track 116 to secure the cover 100 to the track 116.

Regardless of which track 102, 116 is employed, the welt 106 must be threaded into the groove 110 to secure the cover to the boat. This is accomplished by inserting one end of the welt 106 into one end of the groove 110 and sliding the welt 106 completely into the groove 110.

As should be appreciated by those skilled in the art, the process of threading the welt 106 into the groove 110 is cumbersome and often frustrating. Being attached to a large and often heavy cover 100, the welt 106 sometimes binds in the groove 110, requiring the boat owner to reorient the cover 100, the welt 106 or both to complete the threading process.

A variation on this system is illustrated in FIG. 2. Here, the cover 110 includes a zipper 120 disposed adjacent to a lateral edge. The zipper divides the cover 110 into two sections, a strip section 122 and a main body section 124. Accordingly, the strip section 122 may be unzipped from the main body section 124 before its welt 106 is threaded into the groove 110. After the strip 122 is installed, the main body section 124 may be re-attached to the strip 122 by zipping the two sections together.

As may be appreciated, the prior art zipper approach also presents difficulties with installation of the cover 100 onto a boat. Specifically, it may be cumbersome or frustrating to zip the two sections of the cover 100 to one another since the main body section 124 is often large and heavy. In addition, zippers of the length needed for this system are expensive and increase manufacturing cost significantly.

Another difficulty with the track systems 102, 112 is that a watertight seal is not easily formed between the cover 100 and the deck of the boat. As a result, to create a watertight seal, hook and loop fastener strips (Velcro®) or rubber gaskets need to be added to the cover 100 or to the deck of the boat to guarantee an appropriate seal.

These issues with the prior art have created a need for a simpler attachment of a boat cover to a boat.

These needs in the prior art remain unaddressed.

SUMMARY OF THE INVENTION

It is, therefore, one aspect of the invention to provide a system for attachment of a boat cover to a boat without the need for traditional snap fasteners.

It is another aspect of the invention to provide a system for attachment of a boat cover to a boat without the need to thread a welt into a groove on a track that is attached to the deck of a boat.

Another aspect of the invention is to provide an attachment system with an improved aesthetic appearance.

It is still another aspect of the invention to provide a boat cover with a simply, yet easily manipulable construction to facilitate attachment of the boat cover to the boat.

Accordingly, in one embodiment of the invention, an apparatus is provided for attaching a boat cover to a boat. The apparatus includes an elongated member defining a first leg and a second leg. A plurality of notches are defined in the first leg of the elongated member. A flexible cover is affixed to the second leg on the elongated member along at least one edge. A guide is affixable to a deck of a boat. The guide defines at least one securement groove therein, the securement groove accepting the second leg of the elongated member therein.

When the second leg is inserted into the securement groove in the guide, a watertight seal is created.

In another embodiment of the invention, the elongated member comprises a flexible material.

In still another embodiment, the elongated member comprises plastic.

One further embodiment of the invention provides for the elongated member to be affixed to the flexible cover via stitching between the protrusion and the flexible cover.

An additional embodiment of the invention provides that the guide is plastic.

In one further embodiment, the guide further includes a fastener groove through which a plurality of fasteners may be disposed to affix the guide to the deck of a boat.

In yet another embodiment, a fastener cover is insertable in the fastener groove to conceal the fastener groove. The fastener cover may be releasably secured in the fastener groove by engaging side walls of the fastener groove.

In still another embodiment, the flexible cover may be a canvas material.

Other aspects of the invention will be made apparent to those skilled in the art from the description that follows and from the drawings appended hereto.

BRIEF DESCRIPTION OF THE DRAWINGS

The invention will now be described in connection with the drawings appended hereto, where like reference numerals refer to like structures, features, and elements, in which.

DESCRIPTION OF EMBODIMENT(S) OF THE INVENTION

Figure 3:
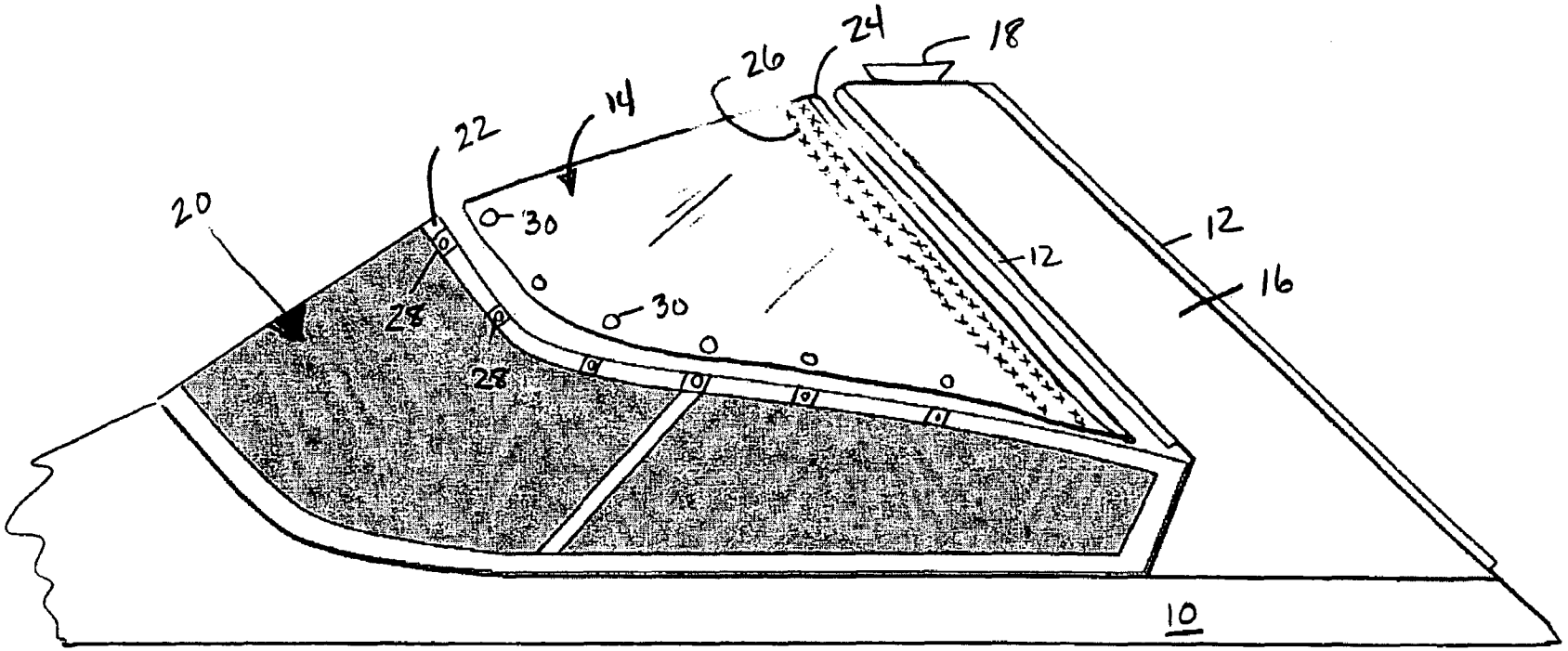
FIG. 3 is a partial side view of a boat including the boat cover attachment system of the invention.

FIG. 3 is a side view illustration of a portion of a boat 10 incorporating the guide 12 and boat cover 14 according to the invention. The guide 12 is illustrated in greater detail in FIGS. 4, 5, and 8.

In FIG. 3, the boat 10 includes what is referred to as a radar arch 16. The radar arch 16 is a structure that extends over the passenger area of the boat 10 and supports electronic equipment, such as a radar transmitter and receiver 18. The radar arch 16 also may support other electronic equipment, such as a radio antenna (not illustrated) or the like. The guide 12 extends along the radar arch 16, both at the forward edge and the trailing edge. As should be appreciated by those skilled in the art, the guide 12 may be disposed along other exposed areas of the boat where the cover 14 (or another cover) is to be attached.

With continued reference to FIG. 3, the boat 10 also includes a windshield 20 disposed forward of the radar arch 16. The top of the windshield 20 includes a top rail 22. The cover 14 includes an elongated member 24 attached along at least one edge via stitching 26. The elongated member 24 removably connects to the guide 12, permitting the cover 14 to be removably attached to the deck of the boat 10. As also shown, a plurality of snap fasteners are included on the edge of the cover 14 adjacent to the top rail 22 of the windshield 20. The snap fasteners include male portions 28, which are disposed on the top rail 22. The female portions 30 of the snap fasteners are affixed to the cover 14. The snap fasteners provide one possible device for attachment of the cover 14 to the top rail 22. Other fasteners and attachment means also may be employed without departing from the scope of the invention.

Figure 4:
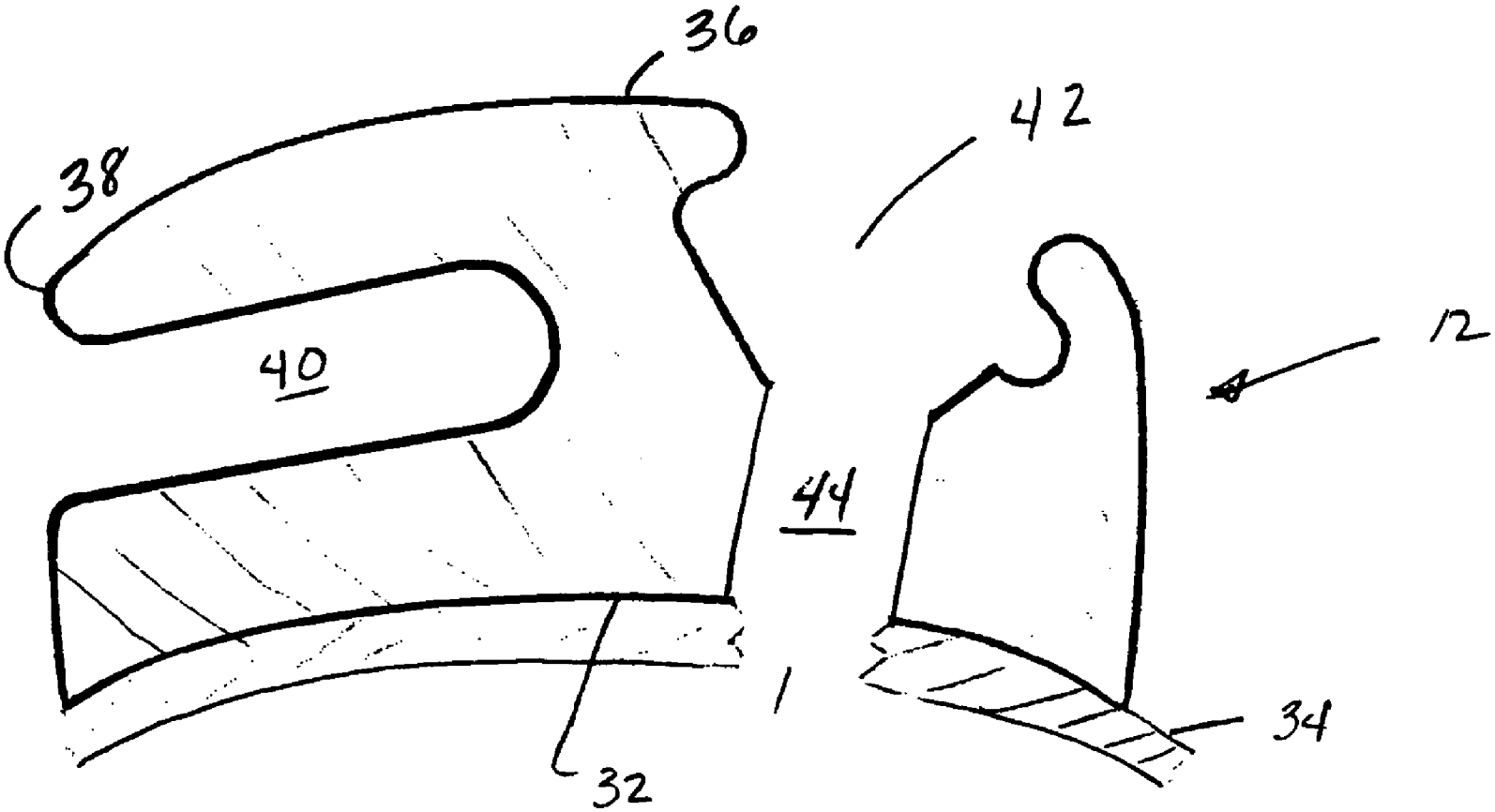
FIG. 4 is a cross-sectional side view of a guide for receiving an edge of a boat cover therein.

FIG. 4 illustrates one embodiment of the guide 12. The guide 12 includes a bottom surface 32 that is disposed against the deck 34 of the boat 10, a portion of which is shown. The deck 34 illustrated in FIG. 4 is a portion of the radar arch 16 illustrated in FIG. 3.

The guide 12 includes a top surface 36, which is visible on the deck of the boat 10. At a forward side of the guide 12, which may face the area in which the boat cover 14 is to be positioned, the guide 12 includes a securement groove 40 that receives a portion of the elongated member 24 therein. The securement groove 40 alternately may face the opposite direction without departing from the scope of the invention. The guide 12 also includes a fastener groove 42. A plurality of guide holes 44 are disposed through the bottom of the fastener groove 42. The guide holes 44 are in register with fastener holes 46 in the deck 34.

With respect to the guide holes 44 and the fastener holes 46, it is contemplated that the holes 44, 46 may be fashioned in the guide 12 and in the deck 34 before installation of the guide 12 thereon. Alternatively, it is contemplated that the guide 12 may be installed on the deck 34 by drilling the guide holes 44 and the fastener holes 46, thereby ensuring that the guide holes 44 and the fastener holes 46 are in register with one another. If the holes 44, 46 are drilled into the guide 12 and the deck 34, they would not be included in the guide 12 at the time the guide 12 is manufactured.

Figure 5:
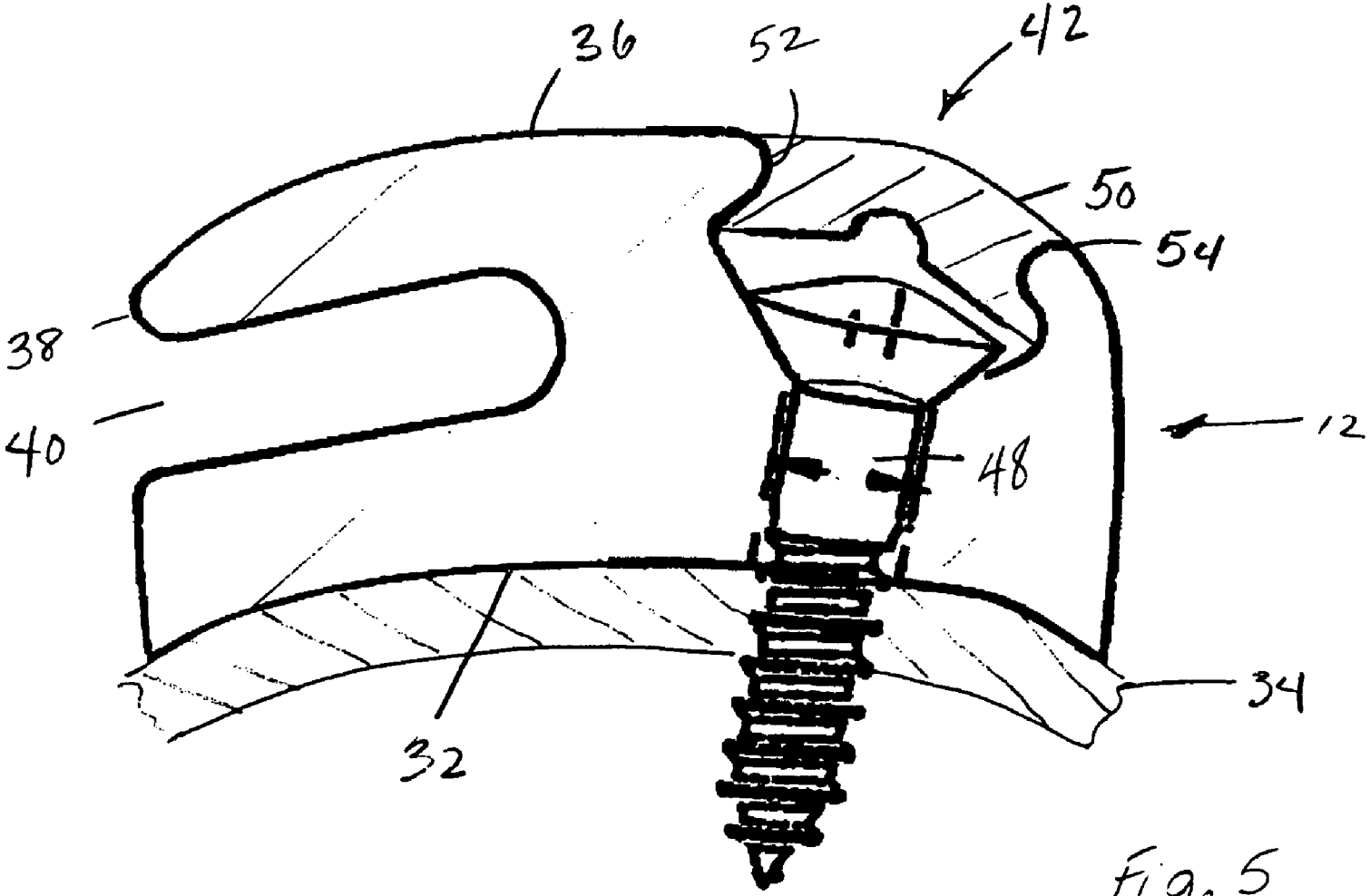
FIG. 5 is a cross-sectional side view of the guide illustrated in FIG. 4, including additional features of the invention.

FIG. 5 illustrates the guide 12 in one contemplated installation on the deck 34. As illustrated, fasteners 48 are inserted into the guide holes 44 and the fastener holes 46 to secure the guide 12 on the deck 34. In the illustrated embodiment, the fasteners 48 are screws. However, as should be appreciated by those skilled in the art, any other suitable fastener may be employed without departing from the scope of the invention.

To cover the fastener groove 42 and the tops of the screws 48, a fastener cover 50 is included as a part of the guide 12. The fastener cover 50 may be made from any suitable flexible material including plastic, rubber, silicone rubber, and the like. The cover 50 is designed to be pressed into the fastener groove 42 to be retained by the side walls 52, 54 thereof. In the illustrated embodiment, the side walls 52, 54 are curved to facilitate retention of the cover 50 therebetween. It is contemplated that the cover 50 is be press-fitted between the walls 52, 54 of the groove 42.

Figure 6:
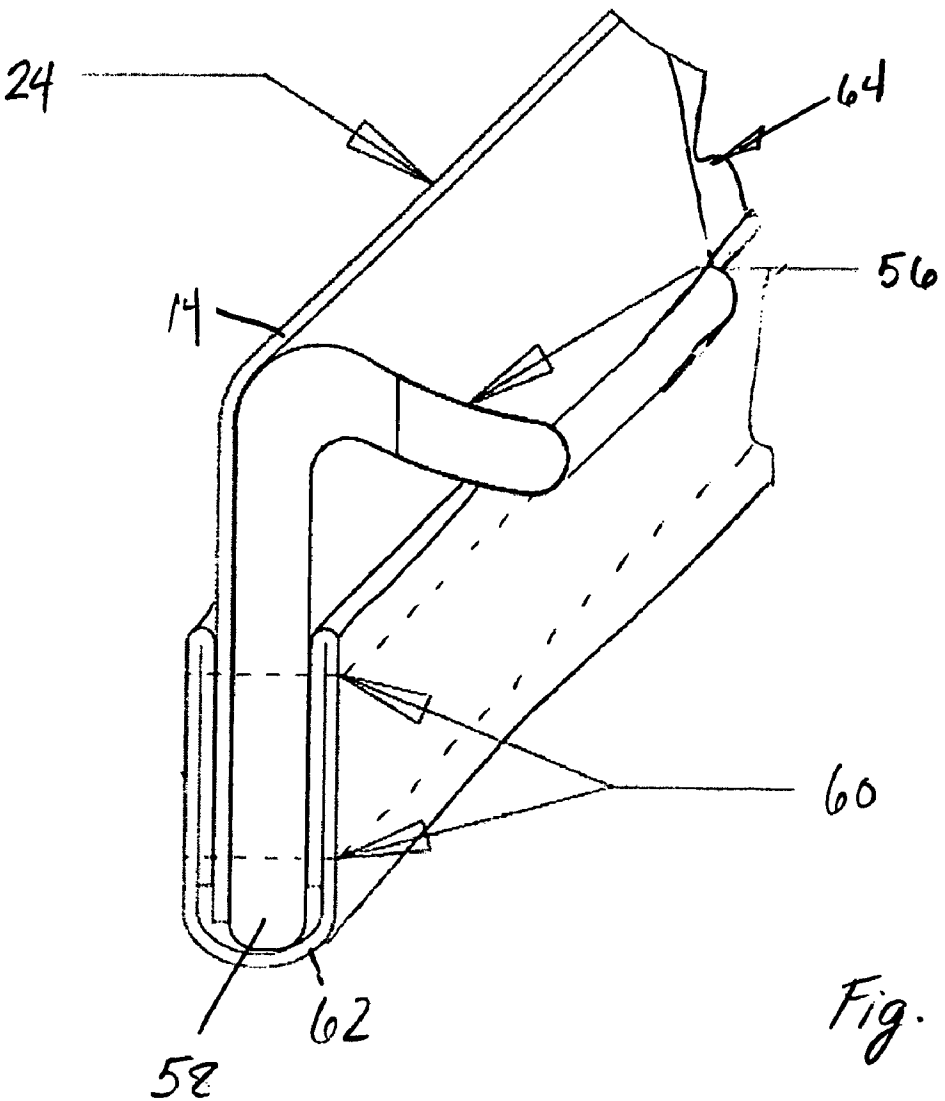
FIG. 6 is a partial cross-sectional side view of the an edge of the cover of the invention, showing details of the elongated member affixed to one edge of the cover.

Referring to FIG. 6, the cover 14 includes the elongated member 24 disposed along at least one of its edges. A portion of the elongated member 24 is inserted into the groove 40 to secure the cover 14 to the boat 10.

The elongated member 24 includes a first leg 56 and a second leg 58. In the embodiment illustrated in FIG. 6, the elongated member is essentially an L-shaped member with the first leg 56 being at about a right angle with respect to the second leg 58. As should be appreciated by those skilled in the art, this particular configuration is not required to practice the invention.

The flexible material that comprises the cover 14 is attached to the second leg 58 of the elongated member 24. In the illustrated embodiment, the second leg 58 is affixed to the cover 14 via stitching 60. Of course, as should be appreciated by those skilled in the art, the elongated member 24 may be affixed to the cover 14 via any other suitable attachment means, including ultrasonic welding, adhesives, etc., or any combination of such means.

So that the edge of the cover 14 has a finished appearance and is aesthetically appealing, the edge of the cover 14 and the end of the second leg 58 are capped with a U-shaped cover 62. As illustrated, the U-shaped cover 62 is affixed to the second leg 58 via the stitching 60.

It is contemplated that the cover 14 will be made from canvas, neoprene, tarpaulin, or any other suitable material. It is also contemplated that the cover 62 will be made from the same material. As should be appreciated by those skilled in the art, however, using the same material for the cover 62 is not required to practice the invention. It is contemplated that the cover may be an entirely different material such as rubber, plastic, a composite material, or even a different woven material.

Figure 7:
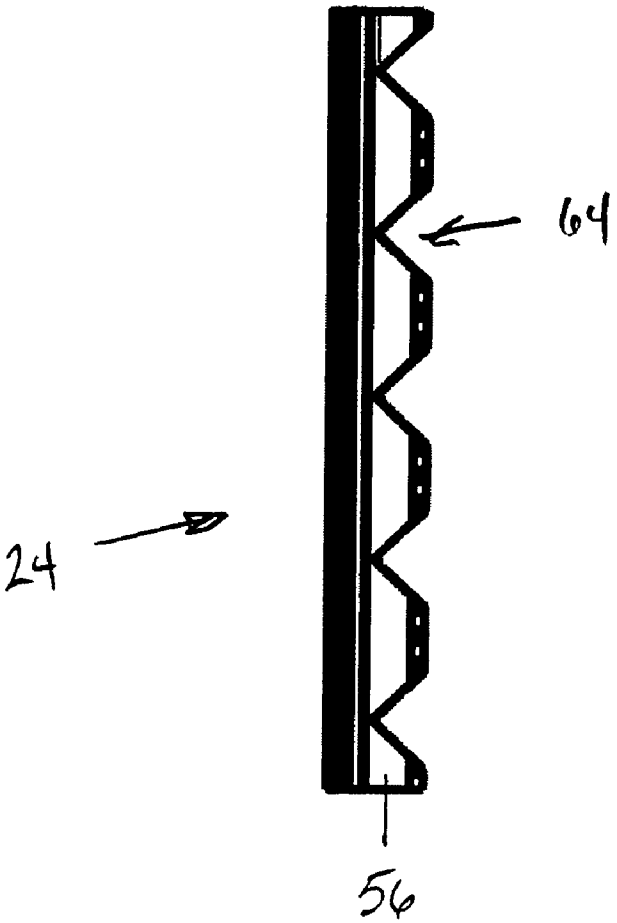
FIG. 7 is a top plan view of the elongated member illustrated in FIG. 6.

With reference to FIGS. 6 and 7, the first leg 56 includes a plurality of notches 64 cut therein. The notches 64 increase the flexibility of the elongated member 24 to improve the operator's ability to insert the second leg 58 into the groove 40.

Figure 8:
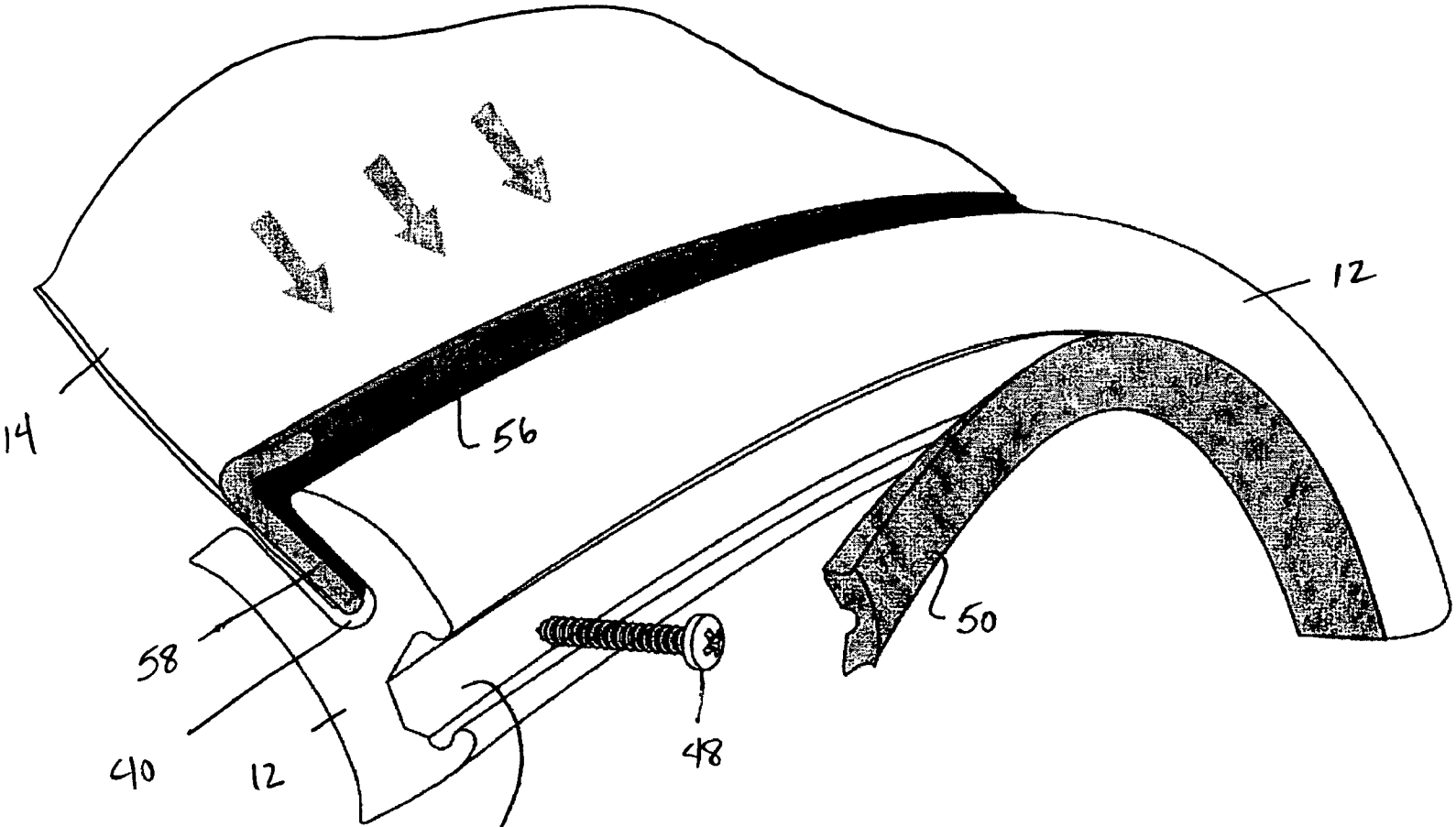
FIG. 8 is a partial perspective illustration of the cover when attached to the guide via the elongated member.

Referring now to FIG. 8, the attachment of the cover 14 to the guide 12 will now be explained. Specifically, the second leg 58 of the elongated member 24 is aligned with the groove 40. Pressure is then applied to the first leg 56 so that the second leg 58 may be pressed into the groove 40 by the boat operator. The arrows provided in FIG. 8 illustrate the direction of the pressure to be applied to the first leg 56 *t* insert the second leg 58 into the groove 40.

It is contemplated that the second leg 58 should be sufficiently resilient and flexible to be retained within the groove 40 after application of pressure on the first leg 56. To facilitate insertion of the second leg 58 into the groove 40, the first leg 56 may have a curved shape, as illustrated in FIGS. 7 and 8. However, a curved first leg 56 is not required to practice the invention. Any alternative shape may be employed without departing from the scope of the invention.

As may be appreciated, a retention force applied by the sides of the groove 40 on the second leg 58 is distributed along the entire length of the groove 40 and the second leg 58. This provides an improved retention of the cover 14 on the deck 34 over snap fasteners, which traditionally are provided at a plurality of discrete locations along the deck 34.

In addition, since the second leg 58 does not need to be aligned with the groove 40 precisely in order to provide an attachment function, the cover 14 may be more easily installed on the boat 10. This arrangement is believed to provide a significant improvement over prior art snap fasteners. As should be appreciated by those skilled in the art, if a boat operator does not match up the snap fasteners exactly, it is likely that the snap fasteners will have to be undone and re-affixed in order for the cover 14 to be properly installed in the boat 10. As may be appreciated, with the attachment apparatus of the invention, this difficulty is avoided altogether.

Figure 1:
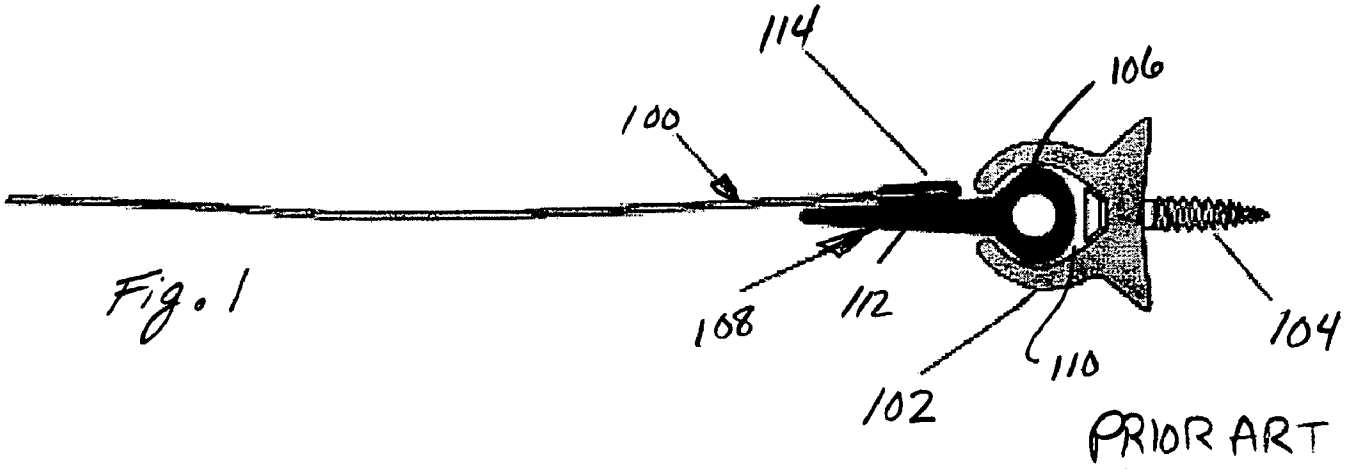
PRIOR ART Fig. 1
FIG. 1 is a cross-sectional side view of a first prior art system for attaching a boat cover to the deck of a boat.
Figure 2:
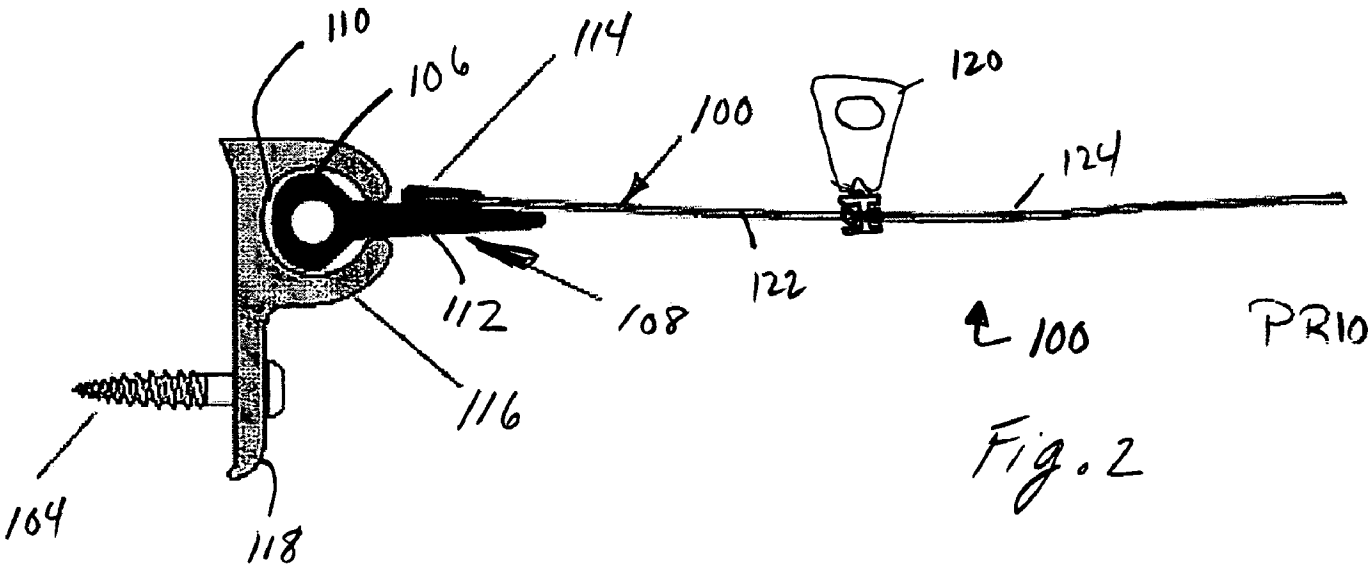
PRIOR ART Fig. 2
FIG. 2 is a cross-sectional side view illustration of a second prior art system for attaching a boat cover to the deck of a boat.

With reference to the prior art examples in FIGS. 1 and 2, problems associated with threading the edge of the cover into a groove are avoided by the invention. Since the second leg 58 need only be pressed into the groove 40, problems associated with the welt binding in the groove are avoided. In addition, the even force applied along the length of the elongated member 24 assures a watertight seal between the cover 14 and the deck 34 of the boat 10.

The embodiments discussed herein are meant to be illustrative of the broad scope of the invention. They are not meant to be limiting of the invention solely to the embodiments described or illustrated. To the contrary, as should be appreciated by those skilled in the art, there are variations and equivalents of the invention that may be employed. The invention is intended to encompass those variations and embodiments.

What is claimed is:

1. An apparatus for attaching a boat cover to a boat, comprising:

an elongated member defining a first leg and a second leg;

a plurality of notches defined in the first leg of the elongated member;

a flexible cover affixed to the second leg of the elongated member along at least one edge;

a guide affixable to a deck of a boat, the guide defining at least one securement groove therein, the securement groove accepting the second leg of the elongated member therein, wherein the elongated member is affixed to the flexible cover via stitching between the second leg and the flexible cover.

2. The apparatus of claim 1, wherein the first leg and the second leg are disposed at about a right angle with respect to one another.

3. The apparatus of claim 1, wherein the first leg is curved.

4. The apparatus of claim 1, wherein the elongated member comprises a flexible material.

5. The apparatus of claim 1, wherein the elongated member comprises plastic.

6. The apparatus of claim 1, wherein the guide comprises plastic.

7. The apparatus of claim 1, wherein the guide further comprises a fastener groove through which a plurality of fasteners may be disposed to affix the guide to the deck of a boat.

8. The apparatus of claim 7, further comprising:

a fastener cover insertable in the fastener groove to conceal the fastener groove.

9. The apparatus of claim 8, wherein the fastener cover is releasably secured in the fastener groove by engaging side walls of the fastener groove.

10. The apparatus of claim 1, wherein the flexible cover is a canvas material.

11. The apparatus of claim 1, wherein, when the second leg is inserted into the securement groove, a watertight seal is established therebetween.

* * * * *